United States Patent [19]

Salto et al.

[11] 4,067,429

[45] Jan. 10, 1978

[54] SELECTOR SYSTEM FOR A PRINTING HEAD FOR PRINTING OFFICE MACHINES

[75] Inventors: Rinaldo Salto, Ivrea (Turin); Domenico Roano, Parella (Turin), both of Italy

[73] Assignee: Ing. C. Olivetti & C., S.p.A., Ivrea (Turin), Italy

[21] Appl. No.: 663,664

[22] Filed: Mar. 4, 1976

[30] Foreign Application Priority Data

Mar. 21, 1975 Italy ..... 67705/75

[51] Int. Cl.[2] ..... B41J 7/34

[52] U.S. Cl. ..... 197/18; 197/55

[58] Field of Search ..... 197/16, 17, 18, 52, 197/55; 178/34

[56] References Cited

U.S. PATENT DOCUMENTS

| | | | |
|---|---|---|---|
| 3,330,398 | 7/1967 | Hylan | 197/16 |
| 3,677,384 | 7/1972 | Link | 178/34 X |
| 3,770,095 | 11/1973 | Guerrini et al. | 196/55 X |
| 3,817,366 | 6/1974 | Blum | 197/16 |
| 3,921,782 | 11/1975 | Kunishima | 197/18 |
| 3,957,149 | 5/1976 | Salto | 197/18 X |

*Primary Examiner*—Edward M. Coven

*Attorney, Agent, or Firm*—Schuyler, Birch, Swindler, McKie & Beckett

[57] ABSTRACT

A selector system for a printing head for use in printing machines and the like for selecting a character to be printed from the printing head. The system comprises at least two actuatable code bars. The printing head is positioned with respect to a first coordinate by the use of a selector lever having a set of pivot elements thereon each defining a pivot axis about which the selection lever pivots a preselected amount. In response to the actuation of the code bars, the pivot element about which the selector lever pivots is selected by two stop members each pivotable in response to the actuation of one of the code bars and each engageable with one of two pivot elements, a third stop member engaged with a third pivot element and not pivoting in response to the actuation of any of the code bars and a fourth stop member engaged with a fourth pivot element and pivotable in response to the actuation of either of the two code bars.

17 Claims, 3 Drawing Figures

SELECTOR SYSTEM FOR A PRINTING HEAD FOR PRINTING OFFICE MACHINES

BACKGROUND OF THE INVENTION

The present invention relates to a selector system for a printing head for printing machines and the like comprising code bars, a selector level with an output element connected to the printing head for selection of the character to be printed, an input element adapted to be shifted by a predetermined amount and a group of fulcrum elements selectively arrestable by a group of stops, controlled by the code bars, for shifting the output element by different amounts.

A selector system of this type is known wherein six stops are each adapted to be set by a respective code bar to position a selector lever in six different positions. This system has the disadvantage that as many code bars are necessary as there are settable stops and, therefore, the system proves to be cumbersome, complicated, costly and not very fast.

SUMMARY OF THE INVENTION

The main object of the present invention is to provide a lever selector system with a group of selectively arrestable fulcrum or pivot elements which is simple, fast and of relatively low cost and which utilizes a number of code bars less than the number of stops for the fulcrum elements.

In accordance with these and other objects the present invention provides a selector system for a printing head for use in printing machines and the like for selecting a character to be printed from the printing head. The system comprises at least two actuatable code bars and means for effecting the positioning of the printing head with respect to a first coordinate comprising a selector lever having a set of pivot elements thereon each defining a pivot axis about which the selector lever pivots a preselected amount. Also provided are means responsive to the actuation of the code bars for selecting the pivot element about which the selector lever pivots, comprising a first group of stop members each pivotable in response to the actuation of one of the code bars and each engageable with one of a corresponding number of pivot elements, a second group of stop members each engaged with one of a corresponding number of pivot elements different from those associated with the first group and not pivoting in response to the actuation of any of the code bars and a third group of stop members each engageable with one of a corresponding numbers of pivot elements different from those associated with the first and second groups and pivotable in response to the actuation of either of at least two of the code bars.

BRIEF DESCRIPTION OF THE DRAWINGS

The invention will be described in more detail, by way of example, with reference to the accompanying drawings, wherein.

DETAILED DESCRIPTION OF THE PREFERRED EMBODIMENTS

The selector system of the present invention may be used as a decoding device in keyboard-operated typewriters, in teleprinters, in printing apparatus of accounting machines or data processors and in printing machines in general.

Figure 1:
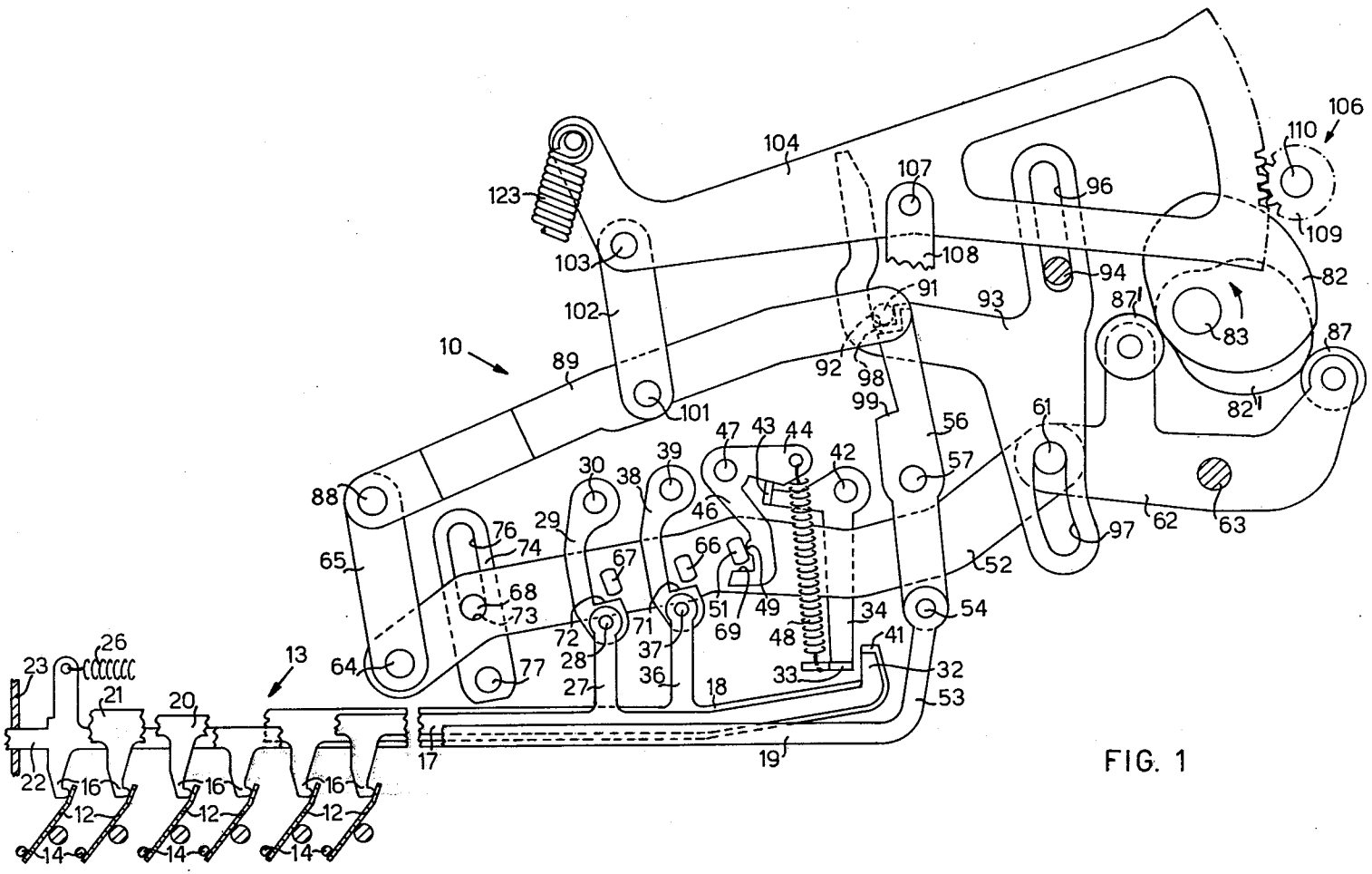
FIG. 1 is a partial longitudinal view of a selector system according to the present invention.

Referring to FIG. 1, the selector system is incorporated here, by way of example, in a typewriter provided with a ball-shaped type head having ninety-six characters distributed in six tracks, each of sixteen characters. The selector system comprises character selector mechanism 10 (FIG. 1), for selecting any one of the sixteen characters of a predetermined track, and track selector mechanism 11 (FIG. 2) for selecting the track in which the character to be printed is situated.

The character selector mechanism 10 and the track selector mechanism 11 are actuated by a set of six code bars 12 (FIG. 1) by means of a corresponding set of bars or sliders 13. The code bars 12 are selectively settable in a known manner per se from a keyboard (not shown in the drawings) and are normally held arrested each against a respective fixed stop 14 by means of a slider (not shown in the drawings). Each code bar 12 configured to co-operate with a lug 16 of the respective slider 13.

Figure 2:
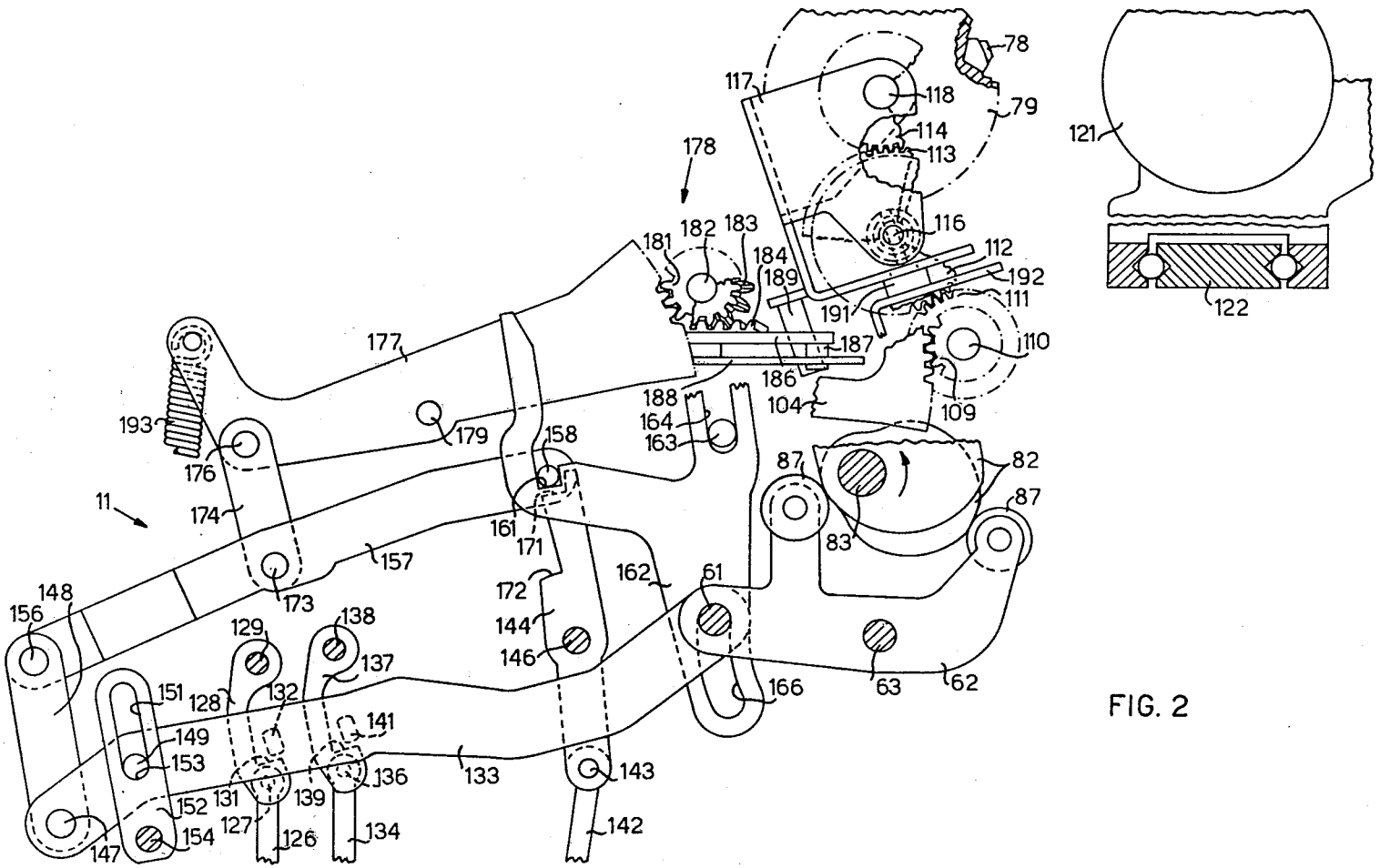
FIG. 2 is another partial longitudinal view of the system of FIG. 1.

The sliders 13 comprise a set of three sliders 17, 18 and 19 of the character selector mechanism 10, and a set of three sliders 20, 21 and 22 of the track selector mechanism 11 (FIG. 2). The sliders 13 (FIG. 1) are guided by guide combs 23, only one of which can be seen in the drawings. A corresponding set of springs 26 normally hold the corresponding sliders 13 arrested with the lug 16 against the respective code bar 12.

The slider 17 has a second lug 27 projecting from its edge by a greater length than, and on the opposite side to, the lug 16 and pivoted on pin 28 of stop 29 which is mounted to turn on spindle 30 of frame 31 (FIG. 3) of the typewriter. The slider 17 (FIG. 1) terminates in an L-shaped shoulder 32 configured to cooperate with lug 33 of transmission lever 34.

The slider 18 includes a second lug 36 extending opposite of the lug 16 and pivoted on pin 37 of stop 38 which is mounted to turn on spindle 39 of the frame 31. The slider 18 terminates in an L-shaped shoulder 41 configured to cooperate with the lug 33 of the transmission lever 34.

Figure 3:
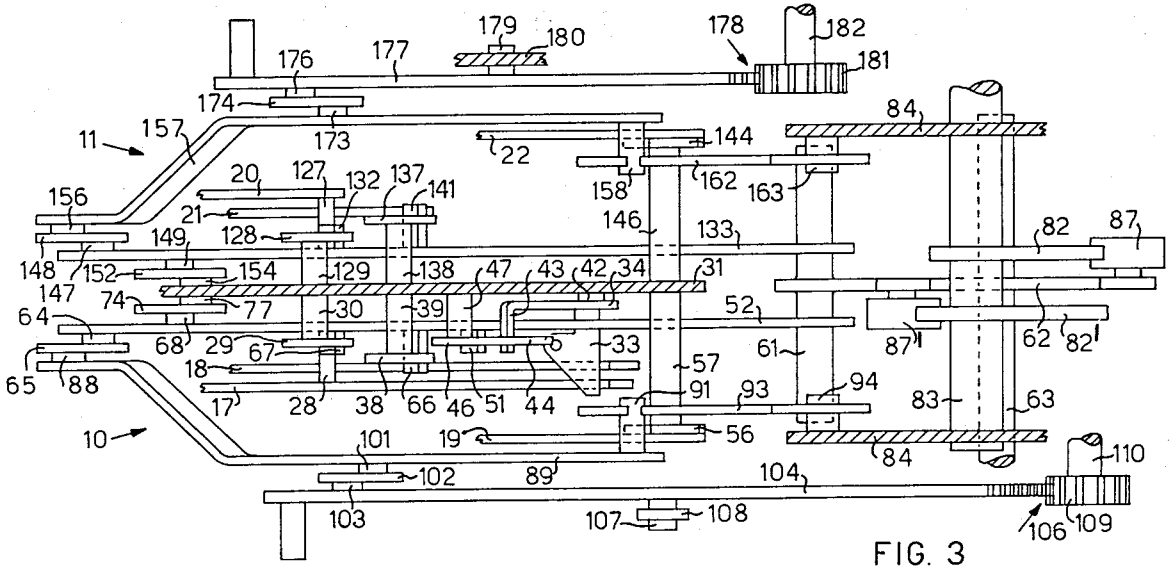
FIG. 3 is a partial plan view of the selector system according to FIGS. 1 and 2.

The transmission lever 34 is mounted to turn on pin 42 of the frame 31 and includes a second lug 43 configured to cooperate with arm 44 of stop 46 which is mounted to turn on pin 47 of the frame 31 (FIG. 3). Spring 48 (FIG. 1) normally holds the transmission lever 34 with the second lug 43 in contact with the arm 44 of the stop 46 and the latter arrested by shoulder 49 against fulcrum element 51 of character selector lever 52.

The slider 19 includes second lug 53 extending opposite of the lug 16 and pivoted on pin 54 of movable support 56 which is mounted to turn on spindle 57 of the frame 31.

The character selector lever 52 is connected at one end by means of pin 61 to an input element including actuating cam frame 62 pivoted on spindle 63 and at the other end by means of pin 64 to an output element constituted by link 65. Fixed to the character selector lever 52, in addition to the fulcrum element 51, are fulcrum elements 66, 67 and 68.

The fulcrum element 51 cooperates not only with the shoulder 49 but also with a second shoulder 69 of the stop 46 in one operative stage of the selector mechanism 10. The fulcrum elements 66 and 67 are configured to cooperate with shoulders 71 and 72, respectively, of the stops 38 and 29 in other operative stages of the selector mechanism 10.

The fulcrum element 68 cooperates with shoulder 75 at one end of slot 76 in lever 74 during a further operative stage. While the lever 74 guides the selector lever 52 by means of the slot 76 during one of the operative stages of the character selector mechanism 10. The lever 74 mounted to turn on pin 77 of the frame 31 and, by means of its slot 76, generally vertically guides the movement of the selector lever 52.

The fulcrum elements 51, 66, 67 and 68 cooperate selectively with the respective shoulders 69, 71, 72 and 73 according to the various code combinations for selecting a series of characters 78 (FIG. 2) disposed on typing or printing head 79.

Actuating means (FIG. 1), which includes a cam 82 and a counter-cam 82', is fixed on a driving shaft 83 which is rotatable in two side plates 84 (FIG. 3). The driving shaft 83 is rotatable cyclically upon every depression of each key in a manner known per se, for example by means of a 360° clutch (not shown in the drawings). The actuating cams 82 and 82' cooperate with two rollers 87, 87' of the input element 62 to shift the right hand end of the character selector lever 52 down by a predetermined amount, and then back to the rest position.

The link 65 (FIG. 1) is connected by means of the pin 64 to the character selector lever 52 and by means of pin 88 to one end of intermediate or actuating lever 89. The actuating lever 89 has, at its other end, change-over element 91 normally accommodated in seat 92 of intermediate element 93 which is movable vertically, guided by means of pin 94 housed in slot 96. Moreover, the intermediate element 93 is controlled and actuated by the actuating means by means of the pin 61 housed in slot 97. The change-over element 91 is configured to cooperate either with shoulder 98 or with shoulder 99 of the movable support 56, so that during one stage of operation the intermediate lever 89 performs two different strokes for each stroke of the link 65, as will be described hereinafter.

The intermediate lever 89 is connected by means of pin 101 to second output element or link 102, which is connected by means of pin 103 to toothed sector 104 of a gearing mechanism indicated generally by 106. The toothed sector 104 is pivoted on pin 107 of movable support 108.

The gearing mechanism 106 includes the toothed sector 104 meshing with pinion 109 rotatable on shaft 110, and four gears 111 (FIG. 2), 112, 113 and 114. The gear 111, which is fixed to the shaft 110, is in mesh wih gear 112 which is rotatable on shaft 116 of frame 117 carrying printing head 79. The gear 113, which is fixed to the shaft 116, is in mesh with the gear 114, which is fixed in turn to shaft 118 to which the printing head 79 is fixed.

The printing head 79 is rotatable with the substantially horizontal shaft 118 to bring the character 78 to be printed in front of platen 121 of conventional carriage 122 movable transversely with respect to the typewriter. The tracks of sixteen characters lie in circles which are centered on the axis of the shaft 118.

The character selector mechanism 10 (FIG. 1) is normally held resiliently at rest by character selection control spring 123 which tends to cause the toothed sector 104 to turn counter-clockwise and urges the intermediate lever 89 downward by means of the link 102. By means of the pin 88, the intermediate lever 89 pushes the link 65 and the character selector lever 52, with the fulcrum element 68 arrested against the shoulder 73 of the lever 74. By means of the change-over element 91, intermediate lever 89 moreover pushes the intermediate element 93, with the end of the slot 97 arrested against the pin 61 of the input element 62, which is controlled in turn by the actuating cams 82, 82'. The actuating cams 82, 82', by means of pin 61, therefore control the selector lever 52 and the change-over element 91 and, consequently, the gearing mechanism 106 with the printing head 79 (FIG. 2).

The slider 20 (FIG. 3) of the track selector mechanism 11 includes a second lug 126 (FIG. 2) projecting from the edge by a greater length than, and extending opposite of the lug 16 (FIG. 1) and pivoted on pin 127 (FIG. 2) of stop 128 which is mounted to turn on spindle 129 of the frame 31. The stop 128 includes shoulder 131 configured to cooperate with fulcrum element 132 of second selector lever 133.

The slider 21 includes second lug 134 extending opposite of the lug 16 and pivoted on pin 136 of stop 137 which is mounted to turn on spindle 138 of the frame 31. The stop 137 includes shoulder 139 configured to cooperate with fulcrum element 141 of the selector lever 133.

The slider 22 includes a second lug 142 extending opposite of the lug 16 and pivoted on pin 143 of second movable support 144 which is mounted to turn on spindle 146 of the frame 31.

The second selector lever 133 is connected at one end by means of the pin 61 to the input element 62 and at the other end by means of pin 147 to first output link 148. Fixed to the second selector lever 133, in addition to the fulcrum elements 132 and 141, is fulcrum element 149 which is housed in slot 151 (FIG. 2) of stop 152 to cooperate with shoulder 153. The stop 152 is mounted to turn on pin 154 of the frame 31. During one operative stage, the fulcrum 149 cooperates with the shoulder 153 to act as a fulcrum and it cooperates in another operative stage with the slot 151 as a guide for the second selector lever 133.

The fulcrum elements 141, 132 and 149 cooperate selectively with the respective shoulders 139, 131 and 153 according to the various code combinations for selecting the track of the character 78 to be printed.

The first output link 148 is connected by means of the pin 147 to the second selector lever 133 and by means of pin 156 to a second intermediate lever 157. The intermediate lever 157 has the pin 156 at one end and, at its other end, it has a second change-over element 158 normally accommodated in seat 161 of second intermediate element 162. The second intermediate element 162 is movable vertically, guided by means of pin 163 of the side plate 84 (FIG. 3) which is housed in slot 164 (FIG. 2). Moreover, the second intermediate element 162 is controlled and actuated by the actuating means utilizing the pin 61 housed in slot 166.

The second change-over element 158 is adapted to cooperate selectively, during one stage of operation of the track selector mechanism 11, either with upper shoulder 171 or with lower shoulder 172 of the movable support 144, so that the second intermediate lever 157 performs two different strokes for each stroke of the link 148, as will be described hereinafter.

The second intermediate lever 157 is connected by means of pin 173 to a second output link 174, which is connected by means of pin 176 to toothed sector 177 of a gearing mechanism indicated generally by the reference 178. The toothed sector 177 is pivoted on pin 179 of support 180 (FIG. 3) fixed to the frame 31.

The gearing mechanism 178 (FIG. 2) includes the toothed sector 177 meshing with pinion 181 rotatable on shaft 182, and a bevel gear 183 fixed to the shaft 182 and meshing with toothed sector 184. The toothed sector 184 is fixed by means of arm 186 and pin 187 to plate 188 which, in turn, is connected by means of pin 189 to the frame 117 carrying the printing head.

The frame 117 is rotatable on sub-vertical shaft 191 on bail 192 to orient the printing head 79 in front of the platen 121 and select the track of the character 78 to be printed. The printing of the selected character 78 takes place by rotation of the bail 192 through the action of a cam (not shown in the drawings), substantially as described in U.S. Pat. No. 3,770,095, until the striking of the printing head 79 against the platen 121 is produced.

The character track selector mechanism 11 is normally held resiliently at rest by track selection control spring 193, which tends to cause the toothed sector 177 to turn counter-clockwise, with the toothed sector pushing the second intermediate lever 157 downwardly by means of the link 174. By means of the pin 156, the second intermediate lever 157 pushes the link 148 and the second selector lever 133, with the fulcrum element 149 arrested against the shoulder 153 by means of the second change-over element 158, the second intermediate lever 157 moreover pushes the intermediate element 162, with the end of the slot 166 arrested against the pin 61 of the input element 62, which is controlled in turn by the actuating cams 82 and 82'. The actuating cams 82, 82', by means of the pin 61, therefore control the second selector lever 133 and the change-over element 158 and, consequently, the gearing mechanism 178 and the frame 117 for the angular positioning of the printing head 79.

By depressing a key of the machine, the counter clockwise rotation of the shaft 83 (FIG. 1) is started in a known manner and, during the first part of the cycle, the bars 12 are positioned according to the code combination corresponding to the depressed key. By means of the rollers 87, the actuating cams 82, 82' cause the input element 62 to turn counter-clockwise and, by means of the pin 61, the input element causes the character selector lever 52 and the track selector lever 133 (FIG. 2) to turn clockwise with the respective fulcrum elements 68 (FIG. 1) and 149 (FIG. 2) on the shoulders 73 and 153, raising the links 65 and 148. At the same time, the intermediate elements 93 and 162 are lowered, following the movement of the pin 61, thus releasing the change-over elements 91 and 158.

As a first example of selection, let it be assumed that the depressed key holds the bars 12 in the position of FIG. 1. The selector lever 52 turns on the fulcrum element 68 until the fulcrum element 51 engages the corresponding shoulder 69. At the same time, the spring 123 causes the change-over element 91 to be arrested against the shoulder 98 of the movable support 56. The selector lever 52, turning clockwise about the fulcrum element 51, raises the actuating lever 89 by the maximum stroke. This is due to the maximum distance of the fulcrum element 51 from the pin 64 and to the minimum distance of the seat 92 from the shoulder 98. The pin 101 of the actuating lever 89 therefore rises by an amount substantially equal to the difference between the stroke of the link 65 and the distance between the seat 92 and the shoulder 98. In the specific case, the pin 101 performs a stroke or travel equal to +3.5 given units and, via the link 102, causes the toothed sector 104 to turn clockwise in opposition to the action of the spring 123. The gearing mechanism 106 transmits the movement to the printing head 79 (FIG. 2), which is rotated counter-clockwise, selecting the fourth row of characters 78 down, starting from the rest position of the head.

Similarly, the second selector lever 133 begins to turn for a brief instant, like the selector lever 52 (FIG. 1), with the fulcrum element 149 (FIG. 2) on the shoulder 153 until it engages the shoulder 139 with the fulcrum element 141, thus raising the link 148. Since the change-over element 158 is free, the spring 193 causes the second intermediate lever 157 to be lowered until it is arrested by the change-over element 158 against the upper shoulder 171 of the movable support 144. In the meantime, the selector lever 133 continues to turn clockwise, raising the intermediate lever 157 and, therefore, the link 174 by means of the link 148 by the maximum stroke equal to +2.5 given units.

The link 174 causes the toothed sector 177 to turn clockwise in opposition to the action of the spring 193. The pinion 181, rotating counter-clockwise with the bevel gear 183, causes a turning movement of the toothed sector 184, the pin 187 and the frame 117 via the pin 189, thus selecting the third track to the right of the character 78 to be printed, starting from the rest position of the head 79. Selection having been completed, the bail 192 causes the frame 117 and the head 79 to strike in a manner against the platen 121 as described in the U.S. Pat. No. 3,770,095.

After rotation through 180°, the actuating cams 82, 82', cause the input element 62 to turn clockwise, raising the intermediate elements 93 (FIG. 3) and 162 by means of the pin 61 and causing the selector levers 52 and 133 to turn counter-clockwise. The springs 123 (FIG. 1) and 193 (FIG. 2) then cause the intermediate levers 89 (FIG. 3) and 157 to be lowered and, by means of the gearing mechanism 106 and 178, bring the head 79 (FIG. 2) back to the original position.

Close to their inoperative positions, the selector levers 53 and 133 cease to engage the shoulders 69 and 139 with the fulcrum elements 51 and 141 and now pivot, by means of the fulcrum elements 68 and 149, on the shoulders 73 and 153. The intermediate elements 93 and 162, by means of their seats 92 and 161, cause the change-over elements 91 and 158 to cease engagement with the shoulders 98 and 171.

As a second example of selection, let it be assumed that the second key depressed positions the code bars 12 (FIG. 1) in such manner as to shift the slider 17 to the left in opposition to the action of the corresponding spring 26. This slider 17 then causes the respective stop 29 to turn clockwise by means of the pin 28, bringing the shoulder 72 out of the path of the fulcrum element 67 and engages the lug 33 with the L-shaped shoulder 32, causing the transmission lever 34 to turn clockwise. By means of the lug 43, this lever 34 causes the stop 46 to turn counter-clockwise, bringing the shoulder 69 out of the path of the fulcrum element 51.

Upon the starting of the actuating cams 82, 82', after the initial rotation of the selector lever 52 with the fulcrum element 68 on the shoulder 73, the fulcrum element 66 engages the shoulder 71 and the lever 52 then turns on the fulcrum element 66, raising the pin 101 by a stroke equal to +2.5 given units, more particularly positioning on the head 79 (FIG. 2) the third row of characters down.

Similarly, if only the slider 18 is shifted, the shoulder 69 out of the path of the fulcrum element 51 by means of the lever 34 and the fulcrum element 67 is arrested by the shoulder 72. The pin 101 shifts by +1.5 given units and the second row of characters down on the hand 79 (FIG. 2) is positioned.

Finally, if both the sliders 17 (FIG. 1) and 18 are shifted, the selector lever 52 will turn with the fulcrum element 68 on the shoulder 73, the pin 101 shifts by +0.5 given units and the first row of characters down on the head 79 (FIG. 2) will be positioned.

It is therefore clear how the system embodying the invention makes it possible to obtain four different positions on the output element 65 (FIG. 1) of the selector lever 52 by shifting in combination only two corresponding code bars 17 and 18, through the use of stop 46 configured to be shifted by each of the two sliders 17 and 18.

Assuming that, together with the sliders 17 and 18, the slider 19 is also shifted, this causes the movable support 56 to turn clockwise, removing the shoulder 98 from the path of the change-over element 91 and positioning the shoulder 99 in place thereof.

The cycle having been started, the spring 123 causes the intermediate lever 89 to be lowered until the change-over element 91 engages the shoulder 99. By means of the link 65, the intermediate lever 89 therefore rises by +0.5 given units and shifts by means of the change-over element 91 by an amount equivalent to the distance between the shoulders 98 and 99 and equal to a positioning by −4 given units. This last amount is greater than the amount of the link 65 and is moreover negative, so that it is the spring 123 that causes the character to be printed to be positioned by means of the gearing mechanism 106 during the lowering of the change-over element 91. The combination of the two movements therefore gives rise to a total shift of −3.5 given units and causes the fourth row of characters from the top to be positioned.

The support 56 (FIG. 1) therefore alters the reference position of the head 79 (FIG. 2) and the selection of the other three rows of characters from the top is effected in dependence upon the combination of positions of the sliders 17 (FIG. 1) and 18 as hereinafter described, as the algebraic sum of the shifts of the elements 88 and 91.

Similarly, for selection of the tracks of characters, by shifting the slider 21 or both the sliders 21 and 20, the corresponding lugs 134 (FIG. 2) and 126 will bring the shoulder 139 of the stop 137 or both the shoulders 139 and 131 of the stops 137 and 128, respectively, out of the paths of the fulcrum elements 141 and 132. By means of the link 148, the intermediate lever 157 will then be shifted by +1.5 or 0.5 given units, respectively, to position the second or first track of characters to the right.

Finally, by shifting the slider 22 (FIG. 3), the movable support 144 is shifted, so that during the lowering of the intermediate element 162 the change-over element 158 is arrested by the shoulder 172 (FIG. 2) and not by the shoulder 171, and the link 174 is shifted by −3 given units which are added algebraically to the shifts defined by the fulcrum elements 149, 132 and 141 to select the three left-hand tracks of the head 79.

During the positioning of the selector mechanisms 10 and 11 (FIG. 3) in the inoperative state, the sliders 13 (FIG. 1) return to the operative state by means of the springs 26 together with the code bars 12 and the spring 48 brings the transmission lever 34 back to the inoperative state together with the stop 46.

The typewriter on which the character selector mechanism 10 and the track selector mechanism 11 (FIG. 3) are mounted is provided with a lower to upper case or shift device known per se and not shown in the drawings, which is connected to control the movable support 108. This device is operated from the keyboard and causes the movable support 108 to be lowered for a specific stroke such that by means of the gearing mechanism 106 it causes the printing head 79 (FIG. 2) to rotate through 180°. Upon altering the reference position of the rows of characters in this way, the operation of the two mechanisms 10 and 11 (FIG. 3) is similar to what has been described in the above-given examples and will select the characters arranged on that part of the head 79 (FIG. 2) which is disposed on the opposite side with respect to the platen 121.

The selector system embodying the invention is particularly simple because of the use of part which in the preferred embodiment are substantially similar to each other. More particularly, the intermediate levers 89 and 157 (FIG. 3), the movable supports 56 and 144, the intermediate elements 93 and 162 and the stops 29, 38, 46, 128 and 137 are alike. Moreover, the character selector mechanism 10 and the track selector mechanism 11 are actuated by actuating means including cams 82, 82', and by a single cam follower.

While preferred embodiments of the invention have been shown by way of example in the drawings, it will be understood that the invention is in no way limited to these embodiments.

What is claimed is:

1. A selector system for a printing head for use in printing machines and the like for selecting a character to be printed from the printing head, said system comprising:

at least two actuatable code bars;

means for effecting the positioning of the printing head with respect to a first coordinate comprising a first selector lever having a set of pivot elements thereon each defining a pivot axis about which the first selector lever pivots a preselected amount; and means responsive to the actuation of the code bars for selecting the pivot element about which the first selector lever pivots, comprising a first group of stop members each movable in response to the actuation of one of the code bars to engage one of a corresponding number of pivot elements, a second group of stop members each engaged with one of a corresponding number of pivot elements different from those associated with the first group and not movable in response to the actuation of any of the code bars and a third group of stop members each engageable with one of a corresponding number of pivot elements different from those associated with the first and second groups and pivotable in response to the actuation of either of at least two of the code bars.

2. A selector system according to claim 1, wherein said set of pivot elements comprises four pivot elements and wherein said first group of stop members include two stop members each engageable with one of two of the pivot elements, said second group of stop members includes a third stop member engaged with a third pivot element and said third group of stop members includes a fourth stop member engageable with the fourth pivot element and movable in response to the actuation of either of the two code bars.

3. A selector system according to claim 2, further comprising actuating means for effecting the pivoting of the first selector lever about one of the pivot elements comprising an input element connected to the first selector lever and shiftable by a predetermined amount, and wherein the system further includes a first output element connected to the first selector lever and movable through a given stroke, a first intermediate lever connecting the first output element to the printing head and means mounting the first intermediate lever to have two different strokes for each said given stroke of the first output element in response to the actuation of the code bars, said mounting means including a first changeover element and a first movable support for selectively arresting said first changeover element and wherein the first changeover element is controlled by the actuating means to be coordinated in its movement with the input element and with the first selector lever.

4. A selector system according to claim 3, wherein the first movable support has two shoulders spaced from each other by a predetermined amount and a first intermediate element spaced from one of the shoulders normally holding the first change-over element inoperative and wherein the first intermediate element is controlled by the input element of the actuating means.

5. A selector system according to claim 4, wherein the first intermediate element has a seat thereon and wherein the system further comprises resilient means for holding the first intermediate lever normally with the first change-over element arrested against the seat of the first intermediate element and the first selector lever arrested with the third pivot element against the third stop member.

6. A selector system according to claim 5, wherein the resilient means comprise a spring for biasing the system to the inoperative state at the end of each print cycle, the actuating means shifting the first selector lever in opposition to the action of the spring.

7. A selector system according to claim 4, further comprising at least two sliders corresponding to the code bars and selectively positionable thereby and wherein the two sliders are each connected to one of said two stop members and wherein the two sliders each have a shoulder configured to coact with a transmission lever connected resiliently to the fourth stop member to effect the movement of the fourth stop member by each of the two sliders.

8. A selector mechanism according to claim 7, wherein each of the said two stop members and said fourth stop member comprises a lever configured to cooperate with the corresponding pivot element of the first selector lever.

9. A selector system according to claim 7, wherein the system further comprises a third slider corresponding to a third code bar which is connected to the first movable support and wherein said first movable support comprises a lever with two radially adjacent axially spaced, shoulders configured to cooperate with the first change-over element of the first intermediate lever.

10. A selector system according to claim 4, further comprising means for effecting the positioning of the printing head with respect to a second coordinate comprising a second selector lever connected to the input element of the first selector lever and having a set of three pivot elements thereon each defining a pivot axis about which the second selector lever pivots a preselected amount and means for selecting one of the three pivot elements about which the second selector lever pivots, comprising three stop members.

11. A selector system according to claim 10, further comprising second output means connected to the second selector lever and movable through a given stroke in response to the pivoting of the second selector lever, a second intermediate lever having a second change-over element, and means for selectively arresting the second change-over element to enable the second intermediate lever to perform two different strokes for each stroke of the second output means comprising a second movable support controlled by one of the code bars and means controlled by the actuating means to coordinate the movement of the second change-over element with that of the input element and the second selector lever.

12. A selector system according to claim 11, wherein the second movable support has two shoulders spaced from each other by an amount substantially equal to the predetermined amount by which the input element is shiftable, and said controlling means including a second intermediate element spaced from the two shoulders for holding the second change-over element normally inoperative, the second intermediate element being controlled by the input element of the actuating means.

13. A selector system as in claim 11, wherein the second intermediate lever is substantially similar in configuration to the first intermediate lever, the second movable support is substantially similar in configuration to the first movable support, the second selector lever is substantially similar in configuration to the first selector lever, and the second intermediate element is substantially similar in configuration to the first intermediate element.

14. A selector system for a printing head for use in printing machines and the like for selecting a character to be printed from the printing head, said system comprising:

at least two actuatable code bars;

means for effecting the positioning of the printing head with respect to a first coordinate comprising a selector lever having a set of pivot elements thereon each defining a pivot axis about which the selector lever pivots a preselected amount;

means responsive to the actuation of the code bars for selecting the pivot element about which the selector lever pivots;

actuating means for effecting the pivoting of the selector lever about one of the pivot elements comprising an input element connected to the selector lever and shiftable by a predetermined amount, and wherein the system further includes an output element connected to the selector lever and movable through a given stroke, an intermediate lever connecting the output element to the printing head and means mounting the intermediate lever to have two different strokes for each said given stroke of the output element in response to the actuation of the code bars, said mounting means including a change-over element and a movable support for selectively arresting the change-over element and means controlled by the actuating means to coordinate the movement of the change-over element with that of the input element and the selector lever.

15. A selector system for a printing head for use in printing machines and the like for selecting a character to be printed from the printing head, said system comprising:

at least two actuatable code bars;

means for effecting the positioning of the printing head with respect to a first coordinate comprising a selector lever having a set of pivot elements thereon each defining a pivot axis about which the selector lever pivots a preselected amount; and means responsive to the actuation of the code bars for selecting the pivot element about which the selector lever pivots, comprising a first group of stop members each movable in response to the actuation of one of the code bars and each engageable with one of a corresponding number of pivot elements;

actuating means for effecting the pivoting of the selector lever about one of the pivot elements comprising an input element connected to the selector lever and shiftable by a predetermined amount, and wherein the system further includes an output element connected to the selector lever and movable through a given stroke, an intermediate lever connecting the output element to the printing head and means mounting the intermediate lever to have two different strokes for each said given stroke of the output element in response to the actuation of the code bars, said mounting means including a change-over element and a movable support for selectively arresting the change-over element and means controlled by the actuating means to coordinate the movement of the change-over element with that of the input element and the selector lever.

16. A selector system according to claim 15, wherein the movable support has two shoulders spaced from each other by a predetermined amount and said controlling means including an intermediate element spaced from one of the shoulders normally holding the change-over element inoperative and wherein the intermediate element is controlled by the input element of the actuating means.

17. A selector system according to claim 16, wherein the intermediate element has a seat thereon and wherein the system further comprises resilient means for holding the intermediate lever normally with the change-over element arrested against the seat of the intermediate element and the selector lever arrested with one pivot element against one stop member.

* * * * *